United States Patent [19]

Rossetti

[11] 3,974,671

[45] Aug. 17, 1976

[54] CYLINDER LOCKS

[76] Inventor: Charles Rossetti, 20 rue du Midi, Lausanne Vaud, Switzerland

[22] Filed: Feb. 13, 1975

[21] Appl. No.: 549,698

[30] Foreign Application Priority Data

Feb. 14, 1974 Switzerland ..... 2079/74

[52] U.S. Cl. ..... 70/375; 70/380; 70/DIG. 60

[51] Int. Cl.[2] ..... E05B 9/04

[58] Field of Search ..... 70/375, 373, 374, 379 R, 70/380, 379 A, 364 R, 364 A, DIG. 60

[56] References Cited

UNITED STATES PATENTS

| | | | |
|---|---|---|---|
| 234,630 | 11/1880 | Towne | 70/375 |
| 1,095,500 | 5/1914 | Hansen | 70/375 X |
| 1,338,053 | 4/1920 | Voight | 70/373 |
| 3,429,154 | 2/1969 | Schwartz | 70/375 |
| 3,698,216 | 10/1972 | Keller-Volper | 70/380 |
| 3,702,553 | 11/1972 | Nolin | 70/375 |

FOREIGN PATENTS OR APPLICATIONS

| | | | |
|---|---|---|---|
| 1,957,791 | 5/1971 | Germany | 70/DIG. 60 |

*Primary Examiner*—Robert L. Wolfe
*Attorney, Agent, or Firm*—Kurt Kelman

[57] ABSTRACT

A cylinder lock comprises two barrels in axial alignment on either side of a web. Each barrel is formed as two opposed elements disposed in either side of a longitudinal plane in which the keyhole is formed by confronting surfaces of the opposed elements. The web is engageable with internal end parts of the barrel elements and each barrel comprises tumblers received in the barrel and operable by a key inserted in the keyhole. A one-piece lock block has a central recess through which the web passes and two rectangular parts on either side of the recess each having a narrow top surface contiguous with one of the barrels. Pins are received in bores in the lock block and the pins are spring-biased to lock the barrels when the key is absent. Two housing members each engage over one of the rectangular parts and the corresponding barrel to maintain the barrels in contact with these parts.

6 Claims, 8 Drawing Figures

Figure 4:
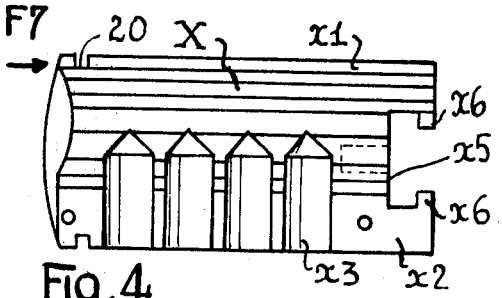

Fig 1
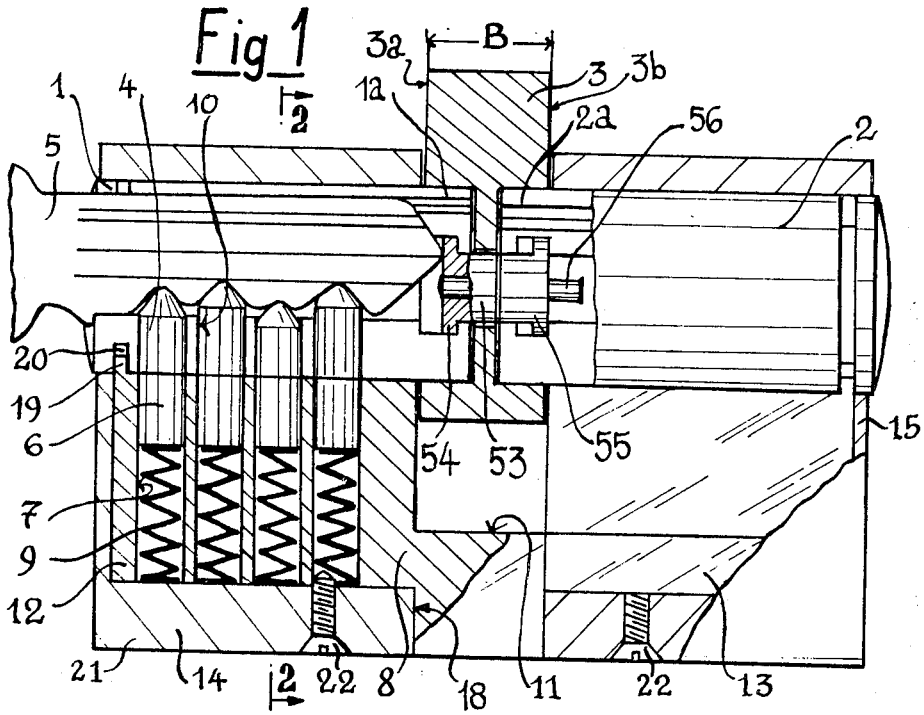
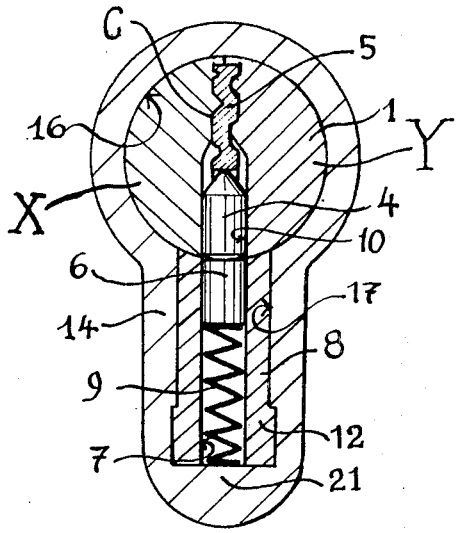
Fig 2
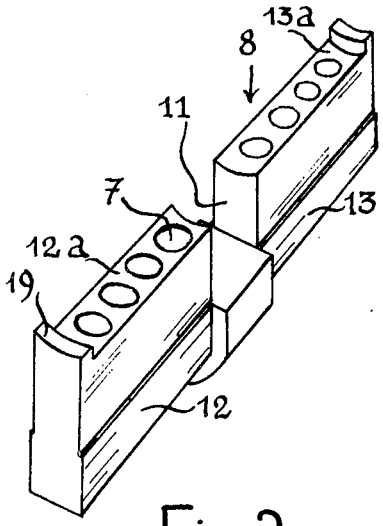
Fig 3

CYLINDER LOCKS

The present invention relates to a cylinder lock.

Cylinder locks are known which comprise a cylinder or barrel formed with a keyhole, tumblers being received in recesses in the barrel and which are moved by the key, such locks also comprising spring-biased pins which are adapted to engage in the recesses of the tumbler-receiving barrel to lock the same upon withdrawal of the key.

In known locks of this kind the barrel is in a single piece, the keyhole being a longitudinal slot which is open at one end, the tumbler recesses being bores in the barrel. Manufacturing the slotted keyhole, which is of complicated cross-section, and providing the transverse bores for the tumblers are delicate and expensive manufacturing operations.

It is an object of the invention to provide a double-barrel lock having novel features which facilitate manufacture.

In accordance with the present invention there is provided in a cylinder lock comprising two barrels in axial alignment on either side of a web and each barrel being formed as two opposed elements disposed on either side of a longitudinal plane. The web is engageable with internal end parts of the barrel elements and each barrel comprises tumblers received in the barrel and which are operable by a key engageable in a longitudinal keyhole slot in the barrel. The keyhole slot lies in the longitudinal plane and the keyhole slot is formed by confronting surfaces of the opposed barrel elements. A one-piece lock block comprises a central recess through which the web is able to pass and two parts of generally rectangular cross section on either side of the central recess, each having a narrow top surface contiguous with one of the barrels. Pins are received in bores in the lock block extending to the latter surfaces, and the pins are spring-biased so that the pins normally engage in recesses in the barrels to lock the same when the key is absent. Two housing members each engage over one of the rectangular parts and the corresponding barrel to maintain the barrels in contact with these parts.

Since the barrel is formed as two elements separated along a plane containing the keyhole it becomes unnecessary to devise a slotted keyhole of complicated cross-section. Also the two barrel elements, which are generally semicylindrical, can readily be produced by die-forming or moulding and the tumbler recesses, half of which are provided in each barrel element, and the shaped side surfaces of the keyhole, each such surface being provided on one of the barrel elements, can readily be prepared directly during die-forming or moulding without any further working steps being necessary and without burring.

The shape of the two barrel elements makes it advantageous to produce them by sintering metal powder between, on the one hand, a die the recess of which has the general shape of a hollow semicylinder and, on the other hand, a ram or punch whose operative surface is shaped to form one of the side surfaces of keyhole and half of each recess for the tumblers. Preferably, therefore, the two barrel elements are made of sintered metal.

The lock block is therefore much smaller than in known double-barrel cylinder locks and the absence of bores for the barrels enables the lock block to be produced more cheaply than previously, for example from sintered metal.

Also, since the barrels are retained on the lock block parts by housing members which can be positioned once the two barrels and the central web have been placed on the lock block, the barrels and the web can be interconnected by connecting means giving them strength lengthwise before the elements are assembled to the lock block. Consequently, the longitudinal connection between the two barrels and the web can be a very simple device which does not increase the cost of a lock.

Other objects and advantages of the invention will become apparent from the following description taken in conjunction with the claims.

Figure 5:
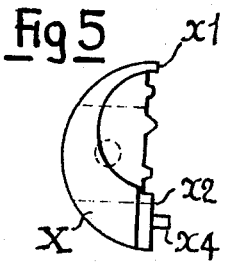
Figure 7:
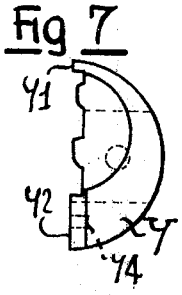
Figure 6:
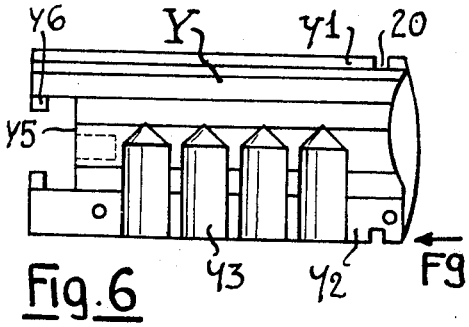
Figure 8:
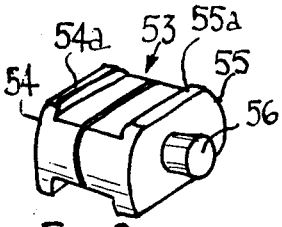

The invention will now be described further by way of example with reference to the accompanying drawings in which:

FIG. 1 is a longitudinal sectional view through a cylinder lock in accordance with an embodiment of the present invention, FIG. 2 is a view taken on the line 2—2 of FIG. 1, FIG. 3 is a perspective view of the lock block shown in FIG. 1, FIG. 4 shows one of the two barrel elements of the lock illustrated in FIG. 1, FIG. 5 is an end view of the element illustrated in FIG. 4, looking in the direction of the arrow F7 of FIG. 4, FIG. 6 shows the other barrel element to that illustrated in FIG. 4, FIG. 7 is an end view of the element illustrated in FIG. 6 looking in the direction of the arrow F9 of FIG. 6, and FIG. 8 is a perspective view of the coupling element of the lock.

The cylinder lock shown in the drawings comprises two barrels 1, 2 axially aligned on either side of a central web, such as a latch, 3. The latch 3 is mounted for movement between inner end parts 1*a*, 2*a* of the barrels 1, 2. A plurality of aligned tumblers 4 are received in corresponding bores 10 in the barrels and are movable by a key 5 engageable in a slot C. The tumblers 4 cooperate with pins 6 received in bores 7, coaxial with the bores 10, in a lock block 8. The pins 6 are biased towards the slot C by springs 9 and are adapted to engage in the tumbler-receiving bores 10 in the barrels to lock the same upon withdrawal of the key.

The block 8, which is shown separately in FIG. 3, is formed on one-piece and has two side parts 12, 13 one on either side of a central recess 11 which recess receives the latch 3. Each part 12, 13 has a narrow top surface 12*a*, 13*a* which is contiguous with one of the barrels and through which the pin-receiving bores 7 extend. The barrels 1, 2 are retained on the side parts 12, 13 by two housing members 14, 15 which each engage over one of the parts 12, 13 and the corresponding barrel.

As can be seen in FIG. 2, the housing member 14 defines a chamber having an upper portion 16 extending the full length of the housing 14 and receiving the barrel 1. The chamber also has a bottom portion 17 which is generally rectangular in cross section. The portion 17 is open at its inner end 18 for receiving the corresponding side part 12 of the block 8.

The axial position of barrel 1 relative to part 12 is determined independently of the housing member 14 by the engagement of a rib 19 on the top surface of the side part 12 in a groove 20 in the barrel 1. The rib 19 is disposed at the outer end of the side part 12.

The bores 7 receiving the pins 6 and springs 9 open onto the bottom wall 21 of the housing member 14. The housing members 14, 15 are slidably engaged on the block 8 after the barrels 1, 2 have been assembled. The housing members are retained axially by screws 22 which extend through the bottom wall 21 into one of the bores 7.

The shape of the block 8 can be seen clearly in FIG. 3 and is very suitable for production by powdered metal sintering in a die-forming operation.

The latch 3 has a width B (FIG. 1) corresponding to the width of the recess 11 and is engaged on the barrel end parts 1*a*, 2*a* which are long enough for the latch 3 to remain assembled on the block 8 even after either one of the barrels 1 or 2 is removed, since the latch 3 remains in engagement with the other barrel and the recess 11.

As shown in FIGS. 4 to 7, the barrel 1 comprises two opposed elements X, Y separated from one another along the longitudinal plane of the barrel containing the shaped key slot C (FIG. 2). Each element X, Y is generally semicylindrical. The two opposed elements X, Y are in abutting engagement with one another by way of lengthwise extending ribs *x*1, *y*1 which cooperate to form the top surface of the key slot C and, on the bottom surface of slot C, being formed by cooperating surfaces *x*2, *y*2. The tumbler-receiving bores 10 are defined by two semicylindrical recesses *x*3, *y*3. Tongues *x*4 and corresponding slots *y*4 provide accurate location of the two opposed elements. Alternatively, the tongues *x*4 can be omitted, in which case axial engagement between the barrel elements is solely by way of the tumblers 4.

The barrel 2 is constructed in two parts in the same way as barrel 1.

The opposed elements X, Y each forming a barrel can, for instance, be manufactured from sintered powdered metal by being pressed in a hollow semicylindrical die by a punch, shaped appropriately to produce the keyhole and the semicylindrical tumbler recesses. Since the elements are made of sintered metal, there is no need to machine them by drifting or drawing and drilling a large number of holes.

The presence of the two ribs *x*1, *y*1 serving as closure members for the key slot on that surface thereof which is remote from the tumblers 4 is another advantage of the invention since the barrel can support the key at its top edge. Improved transverse guiding of the key in the slot is therefore provided independently of key shaping, which shaping need not be as accurate as previously.

The connection of the latch 3 to the barrel in which the key is engaged is by means of a coupling or connecting element 53 having two members 54, 55 rotatable on a spindle 56. The coupling member 53 is shown separately in FIG. 8. The two members 54, 55 are engaged in transverse slots *x*5, *y*5 of the barrels (FIGS. 4 and 6). The slots have a narrow opening bounded between portions *x*6, *y*6 and the members 54, 55 have ribs 54*a*, 55*a* (FIG. 8) which form means for securing the barrels.

The spindle 56, which has end parts limiting the possible axial separation between the members 54 and 55, is long enough for such members to be brought to the end of the corresponding side surface 3*a* or 3*b* of the latch 3. This permits coupling of the latch to the adjacent barrel by a relative lateral movement which engages the member 54 or 55 like a drawer in the transverse slot of the barrel.

The two barrels disposed on either side of the latch 3 are interconnected lengthwise, by means of the coupling member 53, before the barrels are assembled on the lock block 8.

It will be apparent to those skilled in the art that various modifications and variations may be resorted to without departing from the spirit and scope of the invention as defined in the appended claims.

What is claimed is:

1. A cylinder lock comprising two barrels in axial alignment, each barrel being formed as two opposed elements disposed on either side of a longitudinal plane, a web between the barrels and engageable with internal end parts of the barrel elements, the barrels being in alignment on either side of the web and each barrel comprising tumblers received in the barrel and operable by a key engageable in a longitudinal keyhole slot in the barrel, the keyhole slot lying in said longitudinal plane and confronting surfaces of said opposed elements forming the keyhole slot, a lock block formed in one piece and comprising a central recess through which the web is able to pass and two parts of generally rectangular cross section on either side of the central recess, each having a narrow top surface contiguous with one of the barrels pins received in bores in the lock block extending to the latter surfaces, the pins being spring-biased so that the pins normally engage in recesses in the barrels to lock the same when the key is absent, and two housing members each engaging over one of said rectangular parts and the corresponding barrel to maintain the barrels in contact with said parts.

2. A lock as set forth in claim 1 wherein each of the housing members is formed with a recess having a top portion in the form of a hollow cylinder extending right through the housing and in which the barrel is received, and a bottom portion which is substantially rectangular in cross section and which extends to an inside surface of the housing in which the corresponding part of the block is received.

3. A lock as set forth in claim 2 wherein a rib which projects from the narrow top surface of said part of said lock block and which is engaged in a groove in the corresponding barrel determines the axial position of each barrel relative to the corresponding part of said lock block.

4. A lock set forth in claim 1 wherein the lock block is made of sintered powder metal.

5. A lock as set forth in claim 1, which additionally comprises lengthwise extending ribs on said barrel elements by way of which said elements abut one another, said ribs cooperating to define the top surface of the keyhole slot, two semicylindrical recesses provided one in each of the barrel elements defining the barrel recesses.

6. A lock as set forth in claim 1, wherein the two barrel elements are made of sintered powdered metal.

* * * * *